US005806614A

United States Patent [19]

Nelson

[11] Patent Number: 5,806,614

[45] Date of Patent: Sep. 15, 1998

[54] APPARATUS AND METHOD FOR DRILLING LATERAL WELLS

[76] Inventor: Jack R. Nelson, Canadian Triton International, Ltd., 2000 Dairy Ashford, Suite 550, Houston, Tex. 77077-5702

[21] Appl. No.: 780,695

[22] Filed: Jan. 8, 1997

[51] Int. Cl.[6] ..... E21B 15/04

[52] U.S. Cl. ..... 175/61; 166/50; 166/313

[58] Field of Search ..... 175/61, 75, 80, 175/82; 166/313, 50, 117.5

[56] References Cited

U.S. PATENT DOCUMENTS

| | | |
|---|---|---|
| 1,900,163 | 3/1933 | Dana et al. . |
| 1,900,164 | 3/1933 | Dana et al. . |
| 2,492,079 | 12/1949 | Wiley . |
| 2,797,893 | 7/1957 | McCune et al. . |
| 3,330,349 | 7/1967 | Owsley et al. . |
| 4,068,729 | 1/1978 | Peevey . |
| 4,396,075 | 8/1983 | Wood et al. . |
| 4,415,205 | 11/1983 | Rehm et al. . |
| 4,573,541 | 3/1986 | Josse et al. . |
| 4,640,353 | 2/1987 | Schuh . |
| 4,742,871 | 5/1988 | Miffre . |
| 4,807,704 | 2/1989 | Hsu et al. . |
| 5,330,007 | 7/1994 | Collins et al. . |
| 5,353,876 | 10/1994 | Curington et al. . |
| 5,427,177 | 6/1995 | Jordan, Jr. et al. . |
| 5,462,120 | 10/1995 | Gondouin . |
| 5,477,925 | 12/1995 | Trahan et al. . |
| 5,520,252 | 5/1996 | McNair . |
| 5,560,435 | 10/1996 | Sharp . |
| 5,685,373 | 11/1997 | Collins et al. ..... 166/313 |

*Primary Examiner*—William P. Neuder
*Attorney, Agent, or Firm*—Bush, Riddle & Jackson

[57] ABSTRACT

An apparatus and method for drilling a plurality of lateral wells from a main wellbore (10) including a junction joint (16) secured to the lower end of the lowermost casing string (14). The junction joint (16) includes an outer cylindrical housing (18) with a plurality of separate parallel guide tubes or tubular guide members (30A, 30B and 30C) secured to upper and lower plates (22 and 24) of the junction joint (16) and arranged to receive a pipe string. Entrance openings (26A, 26B, and 26C) are provided in upper plate (22) for the respective tubes (30A, 30B and 30C). A guide member (40) includes a small diameter alignment pin (54) and a pair of large diameter projecting pins (50). Upon alignment of guide member (40) with a selected tube (30A) by alignment of small diameter alignment pin (54) with an opening (38A) in upper plate (22), pins (50) are received within the upper ends of the non-selected tubes (30B and 30C) to close the non-selected tubes (30B and 30C). A drill string (76, FIG. 3) is received within the guide member (40) and selected tube (30A) for drilling a laterally extending wellbore. Additional lateral well bores are drilled in a similar manner through the remaining tubes (30B and 30C) after drilling of the first lateral wellbore.

22 Claims, 4 Drawing Sheets

14
10
76
40
44
26A
22
16
18
30A
24
32
34
12
76
78

56
64
14
40
10
50
26A
22
16
30A
82
18
30A
24
32
34
12
80

FIG. 8
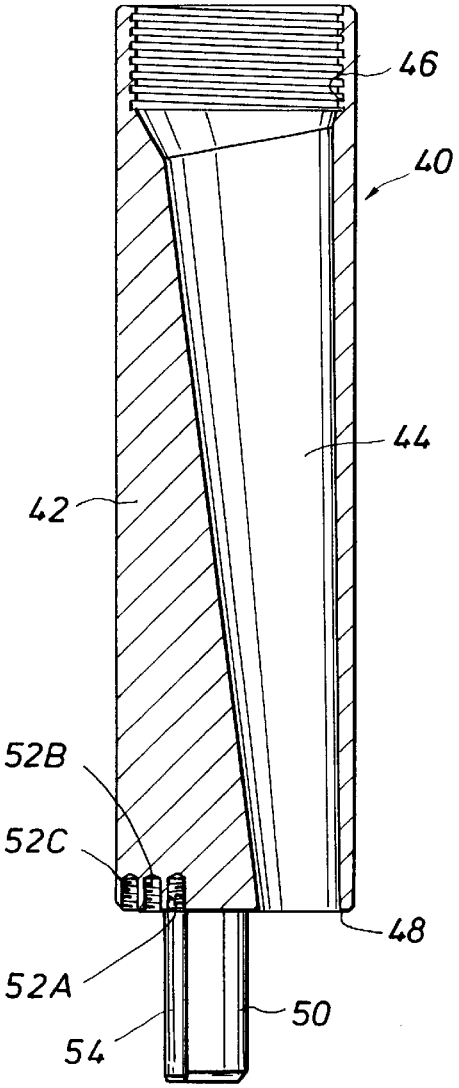
FIG. 10
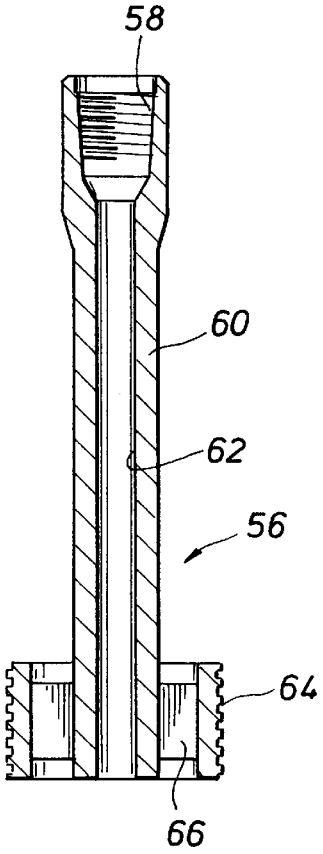
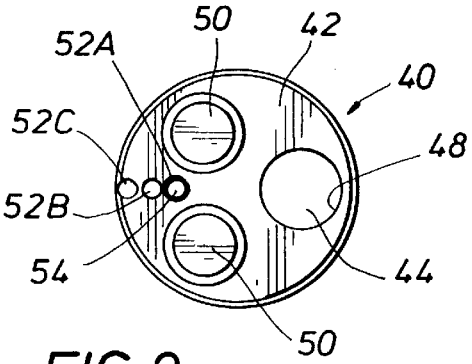
FIG. 9
FIG. 11
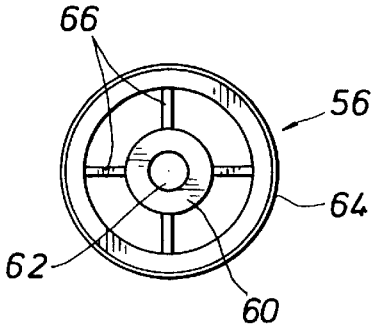

APPARATUS AND METHOD FOR DRILLING LATERAL WELLS

FIELD OF THE INVENTION

This invention relates to an apparatus and method for laterally drilling wells, and more particularly to such an apparatus and method in which a plurality of lateral wells are drilled from a single main wellbore.

BACKGROUND OF THE INVENTION

Many types of oil and gas reservoirs have been drilled laterally (horizontally) resulting in significant production increase. These types of reservoirs may be naturally fractured formations. This allows a single lateral borehole to intersect a number of the fractures and make the borehole a much more efficient producer.

Another application for lateral holes is in tight and low permeability formations. By extending the borehole and increasing the area in contact with the reservoir, lateral boreholes will allow higher production than those obtained from conventional vertically extending boreholes. Other applications for lateral wells or boreholes involve water flood operations, thermal recovery, extensions to inaccessible reservoirs, and obtaining production from reservoirs effected by water and gas coning.

Lateral drilling techniques have been successfully used worldwide and a need exists for a more efficient system in drilling lateral wells, particularly a system in which a plurality of lateral wells are drilled from a single primary wellbore. Several systems have been introduced to the industry but none has provided a re-entry access to individual laterals nor does any system available today provide for casing the laterals and sealing each independently of the main bore junction. Thus, a need exists for new technology in lateral drilling to provide accessibility to each independent lateral borehole, isolation of the formation and producing zones, and lateral juncture pressure sealing integrity.

SUMMARY OF THE INVENTION

The present invention is particularly directed to a system for drilling a plurality of lateral wells from a single main wellbore. The system includes an apparatus and method which utilizes a junction joint connected to the lower end of the lowermost casing string in the main borehole or well. The plurality of lateral wells are drilled from the junction joint in different lateral directions. The junction joint comprises a plurality of generally parallel tubes or tubular members secured between upper and lower plates of a cylindrical housing or box in which the tubes are mounted. A tube is provided for each lateral well drilled and three tubes, for example, are provided for the junction joint if it is desired to drill three lateral wells. The upper and lower plates for the cylindrical housing have aligned upper and lower openings for receiving each tube which is secured to the plates. A tube selector guide member is positioned over the upper plate and has a pair of downward projecting large diameter pins and a small diameter alignment pin. The alignment pin is received within an aligned opening in the upper plate for a selected tube and the pair of large diameter pins are received within the two remaining non-selected tubes for closing the non-selected tubes. The ends of the selected tube are open to receive a work string or drill string. The tube selector and guide member has a downward tapering opening acting as a funnel to guide the work string or drill string downward through the selected tube and the lower plate into the formation.

Each tube has a lower end portion projecting below the lower plate and a float shoe is secured to the lower end of the end portion to permit cement to be discharged from the tube for forming a cement liner about the junction joint, the projecting tube end portions, and the lowermost casing string thereby to seal the interior of the junction joint. After cementing of the main borehole about the junction joint, the cement string is pulled out and the drill string is run in to first drill through the shoe and cement, and then to form the curve and lateral section in accordance with the drilling program predetermined plans.

Then, a liner is run within the lateral borehole, any cementing is completed, and the tubing hanger set and packed inside the selected tube within the junction joint. Upon completion of the lateral well for the selected tube, the liner running tool is removed and the running tool for the tube selector guide member is then run in the borehole and connected to the tube selector guide member for removal from the borehole. The small diameter locator pin is then removed from the opening in the tube selector guide member and positioned in another opening in the guide member for another selected tube. The tube selector guide member is then lowered into the main borehole and aligned by the small diameter alignment pin with the second selected tube on the upper plate. The operation is then repeated for drilling a second lateral borehole from the junction joint. A third lateral borehole may be drilled in a similar manner.

It is the object of this invention to provide a system in which a plurality of lateral wells are drilled from a single main borehole.

Another object of this invention is to provide an apparatus and method for drilling a plurality of lateral wells from a single junction joint connected to the lower end of the lowermost casing string for a main wellbore.

A further object of the invention is to provide such an apparatus and method in which the junction joint has an outer cylindrical housing with end plates and receiving a plurality of parallel tubes or tubular members therein with each tube associated with a separate lateral well and adapted to receive a drill string.

Other objects, features, and advantages of the invention will be apparent from the following specification and drawings.

BRIEF DESCRIPTION OF THE DRAWINGS

FIG. 8 is a sectional view of the tube selector guide member having a pair of large diameter projecting pins for closing a pair of non-selected tubes and a small diameter alignment pin for axially aligning the guide member with the selected tube for receiving the drill string;

FIG. 9 is a bottom plan view of the guide member shown in FIG. 8;

FIG. 10 is a longitudinal sectional view of a running tool having external running threads for mating with internal running threads on the guide member; and, FIG. 11 is a bottom plan view of the running tool shown in FIG. 10.

DESCRIPTION OF THE INVENTION

The present invention is particularly directed to an apparatus and method in which a plurality of lateral wells are drilled from a single main wellbore shown at 10 and having a bottom 12 as shown in FIGS. 1–4. The lowermost casing string in main vertical wellbore 10 is shown generally at 14. Secured to the lower end of casing string 14 in a manner similar to a lower shoe is a junction joint generally indicated at 16 and forming an important part of this invention.

Figure 5:
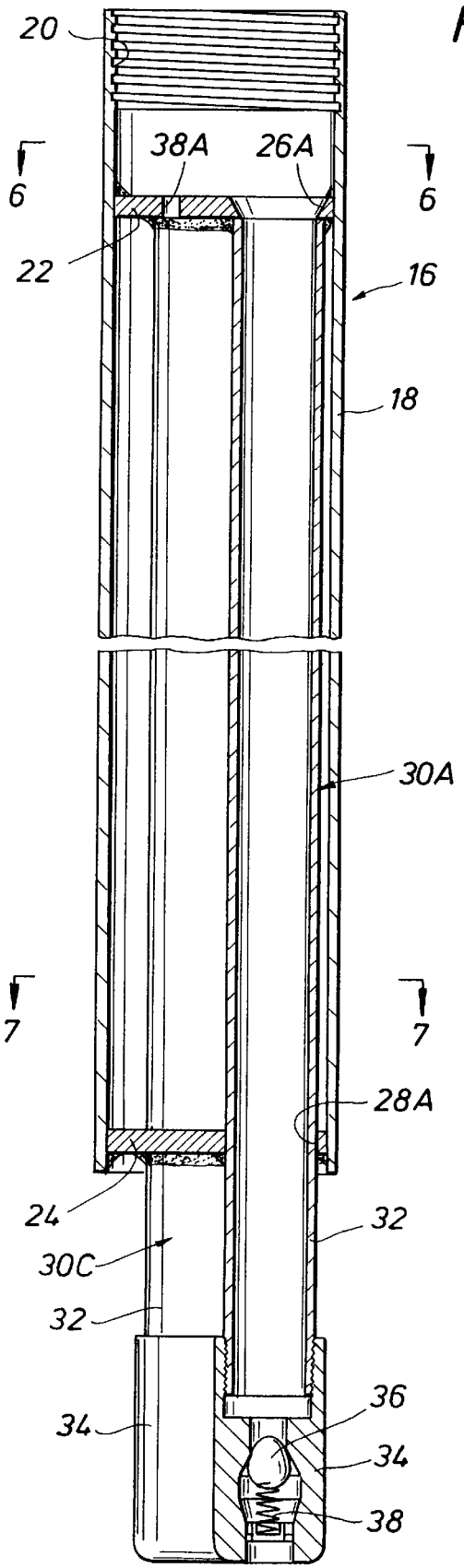
FIG. 5 is a longitudinal sectional view of the junction joint comprising the present invention removed from the wellbore with the selected tube shown in section and having a lower shoe for the discharge of cement into the main borehole.
Figure 6:
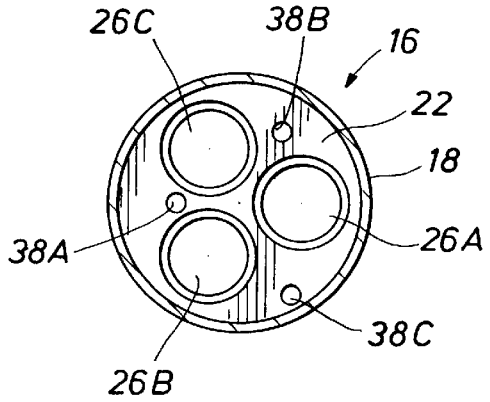
FIG. 6 is a cross-sectional view taken generally along line 6—6 of FIG. 5.
Figure 7:
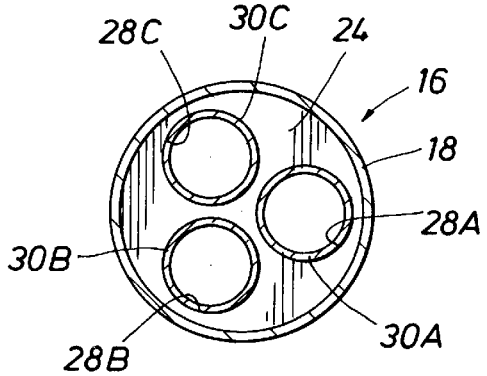
FIG. 7 is a cross-sectional view taken generally along line 7—7 of FIG. 5.

Referring now particularly to FIGS. 5–7, junction joint 16 is illustrated including an outer cylindrical housing 18 having internal threads 20 for connection to the lower end of casing string 14. Upper cover plate 22 closes the upper end of housing 18 and lower cover plate 24 closes the lower end of housing 18. Plates 22 and 24 are welded to the inner periphery of outer housing 18. Upper plate 22 has three tapered entrance openings 26A, 26B and 26C as shown in FIG. 6. Lower plate 24 has three openings 28A, 28B and 28C as shown in FIG. 7 and in axial alignment with entrance openings 26A, 26B and 26C. Three guide tubes or tubular guide members 30A, 30B and 30C are secured, such as by welding, to plates 22 and 24 in axial alignment with respective entrance openings 26A, 26B and 26C. Tubes 30A, 30B and 30C are also received within respective openings 28A, 28B and 28C in lower plate 24. Each tube 30A, 30B and 30C has a projecting end portion 32 below lower plate 24 and a shoe 34 is secured to the lower end of end portion 32. A check valve 36 is urged by spring 38 to a closed position within shoe 34. Upper plate 22 has three alignment openings 38A, 38B and 38C each spaced a different distance from the axial center of housing 18 as shown in FIG. 6 and each opening is associated with a respective tube 30A, 30B and 30C. Cylindrical housing 18 may be around one hundred eighty (180) feet in length with end portion 32 around thirty (30) feet in length, for example.

A tube selector guide member is shown generally at 40 in FIGS. 8 and 9. Guide member 40 has a body 42 with a tapered bore 44 defining an upper relatively large diameter internally threaded opening 46 and a lower relatively small diameter opening 48 which is adapted to align vertically with a selected entrance opening 26A, 26B or 26C for a respective selected tube 30A, 30B or 30C. Projecting from the lower end of body 42 are a pair of relatively large diameter pins or plugs 50 which are adapted to fit within a pair of aligned entrance openings 26B and 26C to close or block entrance openings 26B and 26C to tubes 30B and 30C when tube 30A is the selected tube as shown in FIGS. 1–4. Three internally threaded openings 52A, 52B and 52C are provided in the lower end of body 42 as shown in FIGS. 8 and 9. A small diameter alignment pin 54 is positioned within selected openings 52A, 52B and 52C which are associated with respective tubes 30A, 30B and 30C. As shown in FIGS. 1–4 in which tube 30A is the selected tube for the lateral borehole, pin 54 is threaded within opening 52A for alignment with opening 38A in upper plate 22 for being received within opening 38A. Alignment pin 54 is threaded within opening 52B if tube 30B is the selected tube and threaded within opening 52C if tube 30C is the selected tube.

A running tool is shown generally at 56 in FIGS. 10 and 11 for connection at its internally threaded upper end 58 to a tool string. An elongated body 60 has a central bore 62 and an externally threaded lower hub 64 has webs 66. Hub 64 is adapted to mate with internally threaded opening 46 of tube selector guide member 40. Thus, running tool 56 is utilized for positioning and aligning guide member 40 with a selected tube 30A, 30B or 30C. For alignment, guide member 40 is positioned on plate 22 and rotated until alignment pin 54 is received within the desired opening 38A, 38B or 38C. If tube 30A is the desired tube for the lateral borehole, alignment pin 54 is threaded within opening 52A of guide member 40 and received within opening 38A of plate 22. Large diameter pins 50 are received within the non-selected tubes 38B and 38C to close or plug the associated entrance openings 26B and 26C. Entrance opening 26A for tube 30A is aligned with tapered bore 44 to permit a drill string or work string to be guided into the selected tube 30A.

If tube 30B is the desired tube for the lateral borehole, alignment pin 54 is threaded within opening 52B of guide member 40 and received within opening 38B of plate 22. Large diameter pins 50 are received within entrance openings 26A, 26C and associated non-selected tubes 30A and 30C to close entrance openings 26A and 26C. Likewise, if tube 30C is the desired tube for the lateral borehole, alignment pin 54 is threaded within opening 52C in plate 22. Large diameter pins 50 are then received within entrance openings 26A and 26B and associated tubes 30A and 30B. Selected tube 30C and entrance opening 26C are then in axial alignment with tapered bore 44 to receive a drill string or work string.

OPERATION

FIGS. 1–4 show the operation of the present invention in sequence in which tube 30A is the selected tube for a lateral borehole and tubes 303B and 30C are the non-selected tubes. Subsequent lateral well bores may be drilled from tubes 30B and 30C after drilling of the lateral borehole from tube 30A. Junction joint 16 is secured to the lower end of the lowermost casing string 14. Alignment pin 54 is threaded within opening 52A of guide member 44 and running tool 56 is connected to guide member 44 for lowering guide member 44 within the main wellbore 10. When guide member 44 contacts upper plate 22, guide member 44 is rotated to align alignment pin 54 with opening 38A in upper plate 22. In this position, large diameter pins 50 are received within entrance openings 26B and 26C and tapered bore 44 of guide member 40 is in axial alignment with tube 30A. Running tool 56 is then removed.

Figure 1:
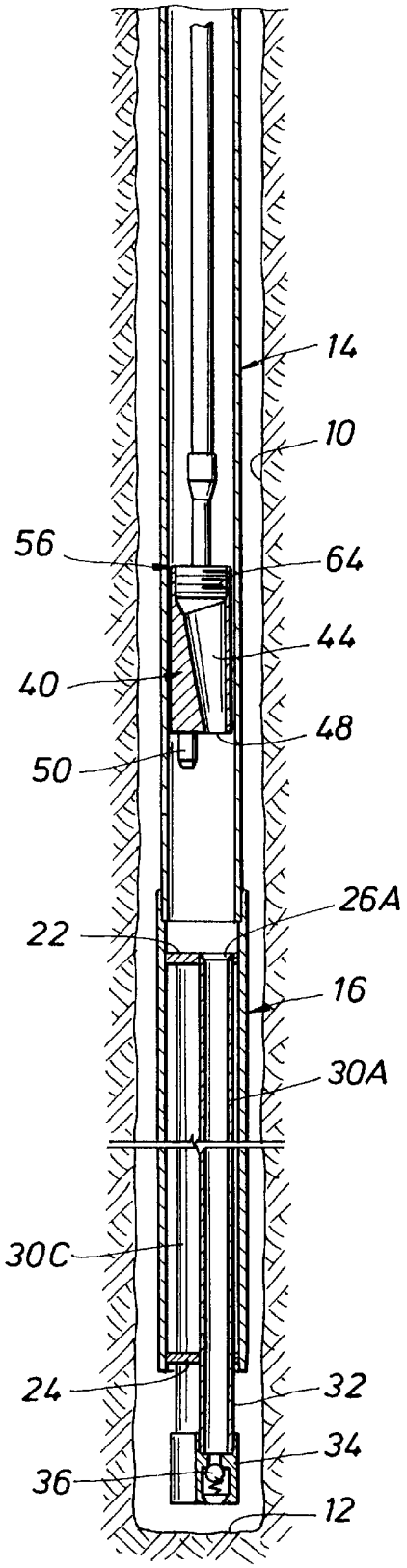
FIG. 1 is a sectional view of a main wellbore having the junction joint of the present invention secured to the lower end of the lowermost casing string adjacent the bottom of the borehole with a running tool and tube selector guide member being lowered within the well.
Figure 2:
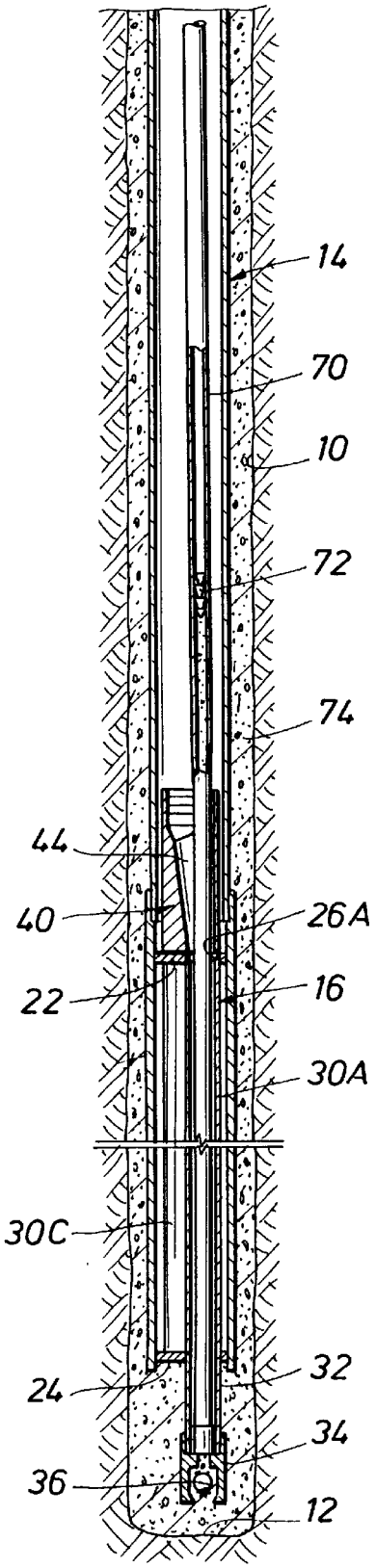
FIG. 2 is a view similar to FIG. 1 but showing the junction joint of the present invention incased in cement with a cementing string positioned within a selected tube in the junction joint for discharging cement from the end of the selected tube.
Figure 3:
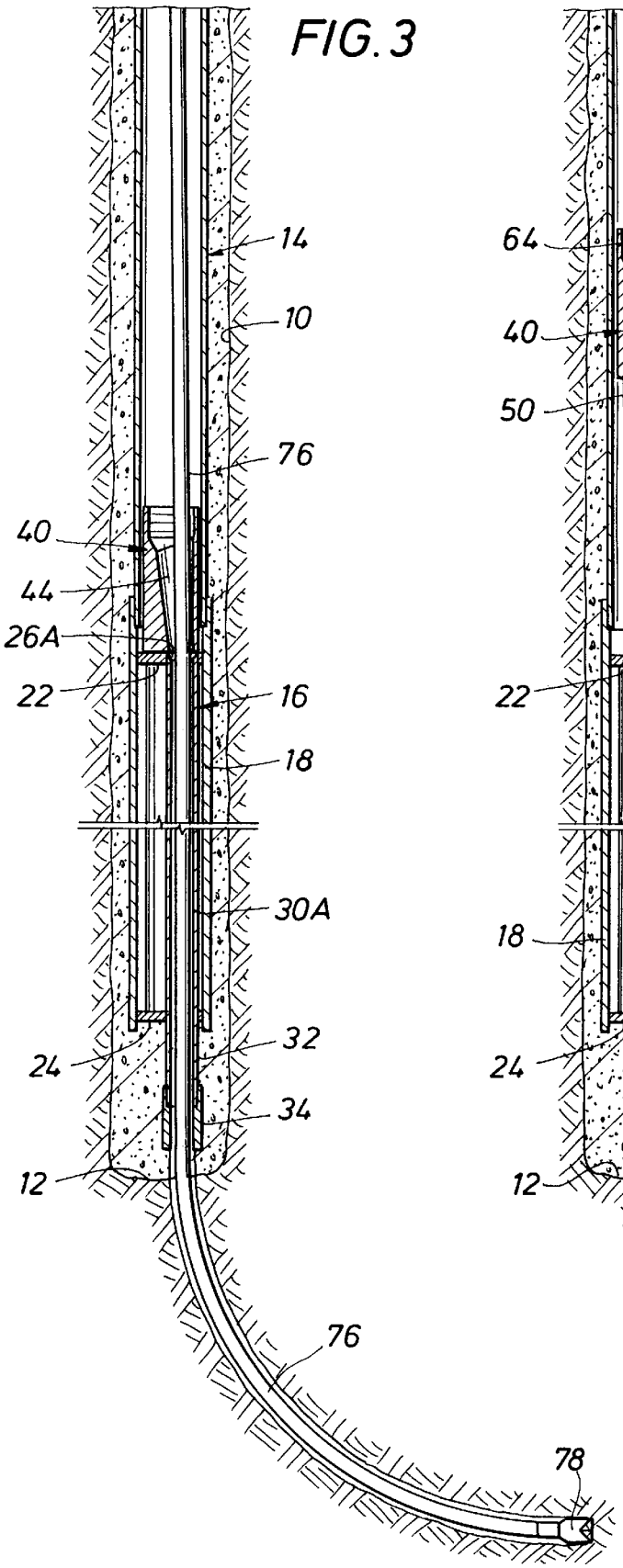
FIG. 3 is a sectional view similar to FIGS. 1 and 2 but showing the cementing string removed and the tube selector guide member in alignment with a selected tube for receiving a drill string which drills through the lower shoe and cement for the lateral drilling of a lateral wellbore.
Figure 4:
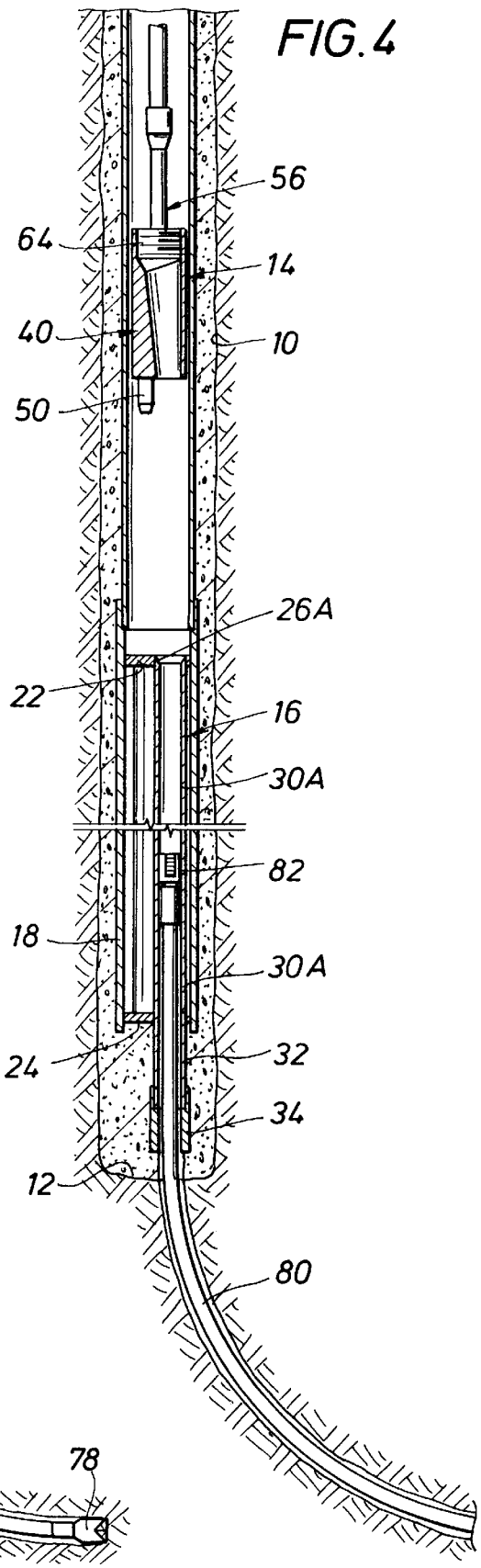
FIG. 4 is a sectional view similar to FIGS. 1–3 but showing the string removed with a liner string attached to a hanger is set within the junction joint, the running tube with the tube selector guide member thereon shown being lowered for selection of another tube for the drilling of a second lateral wellbore.

Next a cementing string shown at 70 in FIG. 2 is run downhole and received within tube 30A with its lower end stabbed and secured to shoe 34. Cement is pumped through the cementing string with suitable darts 72 forcing the cement downwardly for discharge through shoe 34 into borehole 10 and upwardly about junction joint 16 and casing string 14. A cement liner 74 encases junction joint 16 and lowermost casing string 14 together with lower projecting portions 32 of tubes 30A, 30B and 30C. After cementing borehole 10, cementing string 70 is then withdrawn. Then, as shown in FIG. 3, a drill string 76 having a drill bit 78 thereon is run within the borehole for drilling the curve and lateral section in accordance with the drilling program after first drilling through lower shoe 34 and the cement liner. The drill string 76 is then removed and a liner string 80 on the end of hanger 82 is set and packed within tube 30A as shown in FIG. 4. Liner string 80 may be cemented if desired. Upon setting of hanger 82, the hanger running tool (not shown) is removed from the wellbore.

Now, junction joint 16 is utilized for drilling a second lateral wellbore through tube 30B which is the tube selected for the lateral borehole. Tubes 30A and 30C are now the non-selected tubes. Running tool 56 is connected to guide member 40 for withdrawal of guide member 40 as shown in FIG. 4 to a position so that alignment pin 54 may be removed from opening 52A and threaded within opening 52B. Then, guide member 40 is lowered onto upper plate 22 and rotated until alignment pin 54 is received within opening 38B in upper plate 22. In this position, large diameter pins 50 are received within entrance openings 26A and 26C for plugging associated tubes 30A and 30C. Tapered bore 44 is aligned with entrance opening 26B and associated tube 30B. Running tool 56 is then removed and drill string 76 inserted within guide member 40 and tube 30B for completion of a second lateral borehole in a manner similar to that described for tube 30A. After completion of the lateral borehole from tube 30B, a third lateral borehole may be drilled through tube 30C in a similar manner.

From the above, it is apparent that a drilling system has been provided by the present invention for the drilling of a plurality or lateral wells from a single main wellbore by providing a wellbore junction joint on the end of a casing string in the main wellbore. Each lateral borehole is independently drilled, cased, and sealed off inside the junction joint. A reentry access to each of the individual lateral well bores is provided by the present apparatus and method. While the present invention as shown in the drawings illustrates an apparatus and method for the drilling of three separate well bores, it is understood that the present invention may be provided for drilling of two or more lateral well bores.

Since certain changes or modifications may be made in the disclosed embodiment without departing from the inventive concepts involved, it is the aim of the appended claims to cover all such changes and modifications following in the true spirit and scope of the present invention.

What is claimed is:

1. Apparatus for drilling a plurality of laterally extending wells from a main well bore comprising:

a casing string within the main wellbore;

an elongate junction joint connected to the lower end of said casing string within said wellbore, said junction joint including an outer tubular housing having upper and lower mounting members within said housing with said mounting members having a plurality of aligned openings therein;

a plurality of generally parallel tubular guide members secured to said mounting members in axial alignment with said aligned openings and extending downwardly from the lower end of said lower mounting member; each tubular guide member arranged to receive a drill string for drilling of a laterally extending well from said junction joint; and selector means above said upper mounting member for receiving and guiding a drill string into a selected aligned tubular guide member while blocking entry of the drill string into a non-selected tubular guide member, said upper and lower mounting members being secured to said outer tubular housing adjacent the upper and lower ends of said tubular housing, said guide members being received within said aligned openings in said mounting members and secured to said mounting members adjacent upper and lower ends of said guide members.

2. Apparatus as set forth in claim 1 wherein said selector means comprises a selector member over the openings in said upper mounting member and having a tapering bore in alignment with the opening for the selected tubular guide member in said upper mounting member while blocking the opening for the non-selected tubular guide member.

3. Apparatus as set forth in claim 1 wherein adjustable means permit said selector means to be in axial alignment with any selected tubular guide member while blocking entry of the drill string into a non-selected tubular guide member.

4. Apparatus as set forth in claim 3 wherein said selector means includes a selector member having a downwardly tapering bore in axial alignment with the opening in said upper mounting member for the selected tubular guide member for receiving the drill string.

5. Apparatus as set forth in claim 1 wherein said mounting members have three pair of aligned openings therein and three tubular guide members are in axial alignment with said three pairs of aligned openings, said selector means when aligned with a selected guide member blocking the openings to the two non-selected guide members from receiving a drill string.

6. Apparatus as set forth in claim 1 wherein said selector means has a relatively large diameter pin extending downwardly therefrom for fitting within said non-selected tubular guide member to block entry of the drill string therein.

7. Apparatus as set forth in claim 1 wherein cooperating registering members are arranged on said selector means and said upper mounting member for each of said guide member.

8. Apparatus as set forth in claim 1 wherein said upper and lower mounting members comprise circular plates secured to said outer tubular housing, and cooperating registering means are arranged on said selector means and said upper mounting plate for each of said guide members.

9. Apparatus as set forth in claim 8 wherein said cooperating registering means comprise a downwardly extending alignment pin on said selector means and an aligned opening in said upper mounting plate to receive said alignment pin at a predetermined position of said selector means.

10. Apparatus for drilling a plurality of laterally extending wells from a main well bore comprising:

a lowermost casing string within main wellbore;

a junction joint connected to the lower end of said lowermost casing string within said wellbore; said junction joint having an outer housing and a plurality of generally parallel tubular guide members therein, each tubular guide member having a lower end portion projecting downwardly from said outer housing into said main wellbore;

selector means adjacent the upper end of said junction joint to guide a pipe string into a selected tubular guide member with the non-selected tubular guide members being blocked;

a shoe on said lower end of each of said tubular guide members;

a cement string received within said selector means and a selected guide member, said cement string extending downwardly to said shoe of the selected guide member for the discharge of cement into the main borehole prior to drilling for forming a cement liner about said housing; and a drill string received with said selector means and selected guide member after discharge of said cement and removal of said cement string for first drilling through said cement liner and then drilling laterally outwardly from said junction joint.

11. Apparatus as set forth in claim 10 wherein said selector means has a downward tapering bore in axial alignment with said selected tubular guide member for receiving a pipe string.

12. Apparatus as set forth in claim 11 wherein:

said shoe has a check valve therein to prevent upward fluid flow, said shoe and said check valve for a selected tubular guide member being drilled through by the drill string upon drilling of a lateral borehole from said junction joint.

13. Apparatus as set forth in claim 10 wherein said junction joint has an entrance opening for each tubular guide member and said selector means includes a pair of downwardly projecting plugs for fitting within the entrance openings to non-selected tubular guide members for closing said entrance openings and said non-selected tubular guide members when said selector means is aligned with a selected tubular guide member.

14. Apparatus as set forth in claim 13 wherein said selector means includes a selector member having said pair of downwardly projecting plugs thereon and a downwardly tapering bore for alignment with a selected tubular guide member.

15. Apparatus as set forth in claim 10 wherein a running tool is mounted within said main wellbore and said selector means includes a threaded upper end for releasable connection to said running tool.

16. A method for drilling a plurality of laterally extending wells from a main wellbore at a junction joint positioned downhole in the main wellbore and connected to the lower end of a casing string; said method comprising the following steps:

providing an elongated junction joint housing for said junction joint connected to the casing string with said junction joint housing having a plurality of downwardly extending generally parallel tubular guide members therein, each tubular guide member adapted to receive a drill string for drilling a predetermined lateral wellbore;

providing an entrance opening in said junction joint housing for each of said tubular guide members;

selecting an entrance opening for a selected tubular guide member to receive a drill string for drilling a laterally extending wellbore;

providing a selector member having a downwardly tapering bore for axial alignment with the selected entrance opening and having a downwardly extending plug for axial alignment with the non-selected tubular guide member;

lowering said selector member within said junction joint housing with said plug extending within and blocking the entrance openings for the non-selected tubular guide member; and guiding the drill string into the selector member and entrance opening for the selected tubular guide member.

17. The method as set forth in claim 16 further comprising the steps of:

withdrawing the drill string from the selected tubular guide member upon completion of the associated lateral wellbore;

selecting another entrance opening for another selected tubular guide member;

blocking the entrance opening in the remaining non-selected tubular member; and guiding the drill string into said entrance opening for said another selected tubular guide member for drilling a second laterally extending wellbore.

18. The method as set forth in claim 16 further including the steps of:

positioning a cementing string within the selected tubular guide member prior to positioning of the drill string within the selected tubular guide member;

discharging cement from the cementing string into the main wellbore for distributing cement to form a cement liner about the junction joint and the casing string;

removing the cementing string from the selected tubular guide member and junction joint after discharge of the cement;

then guiding the drill string into the selected entrance opening for the selected tubular guide member for first drilling through the cement in the borehole; and next drilling laterally outwardly for the desired lateral wellbore.

19. A method for drilling a plurality of laterally extending wells from a main wellbore at a junction joint positioned downhole in the main wellbore and connected to the lower end of the casing string; said method comprising the following steps:

providing an elongated junction joint housing for said junction joint connected to the casing string with said junction joint housing having a plurality of downwardly extending generally parallel tubular guide members therein, each tubular guide member having a lower end portion projecting downwardly from said housing into said main wellbore;

providing a shoe on the lower end of each of said tubular guide member;

providing selector means on the upper end of said junction joint to guide a pipe string into a selected tubular guide member with the non-selected guide members being blocked, the selector means including a bore to receive a pipe string;

positioning a cementing string within the bore of said selector means and within the selected tubular guide member with the cementing string extending to the shoe of the selected tubular guide member;

discharging cement from the cementing string through said shoe into the main wellbore to form a cement liner about said housing;

removing the cementing string from the selected tubular guide member and wellbore after discharge of the cement;

then guiding a drill string into the bore of the selector means and within the selected tubular guide member for first drilling through the cement liner in the borehole; and then drilling laterally outwardly for the cement lateral wellbore.

20. The method as set forth in claim 19 including the step of:

providing said selector means with a downwardly tapering bore to receive a pipe string; and guiding the pipe string into an entrance opening of the selected tubular guide member.

21. The method as set forth in claim 20 including the steps of:

providing a pair of downwardly projecting plugs on a selector member of said selector means; and positioning said plugs within entrance openings to non-selected tubular guide members when said selector means receives said selected tubular guide member within said tapering bore.

22. Apparatus for drilling a plurality of laterally extending wells from a main well bore comprising:

a casing string within the main wellbore;

an elongate junction joint connected to the lower end of said casing string within said wellbore, said junction joint including an outer tubular housing having upper and lower mounting members within said housing with said mounting members having a plurality of aligned openings therein;

a plurality of generally parallel tubular guide members secured to said mounting members in axial alignment with said aligned openings and extending downwardly from the lower end of said lower mounting member; each tubular guide member arranged to receive a drill string for drilling of a laterally extending well from said junction joint; and selector means above said upper mounting member for receiving and guiding a drill string into a selected aligned tubular guide member while blocking entry of the drill string into a non-selected tubular guide member, said selector means including a selector member over the openings in said upper mounting member, and cooperating registering members arranged on said selector member and said upper mounting member for each of said guide members, said registering members being adjustable and mating for a selected guide member.

* * * * *